US007585608B2

(12) United States Patent
Hong et al.

(10) Patent No.: US 7,585,608 B2
(45) Date of Patent: Sep. 8, 2009

(54) METHOD OF PREPARING TONER AND TONER PREPARED USING THE METHOD

(75) Inventors: Chang-kook Hong, Suwon-si (KR); Kyung-yol Yon, Seongnam-si (KR); Jun-young Lee, Seoul (KR); Min-young Cheong, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/595,868

(22) Filed: Nov. 13, 2006

(65) Prior Publication Data

US 2007/0154830 A1 Jul. 5, 2007

(30) Foreign Application Priority Data

Jan. 5, 2006 (KR) ..... 10-2006-0001312

(51) Int. Cl.
*G03G 9/087* (2006.01)

(52) U.S. Cl. ..... 430/137.14; 430/137.15

(58) Field of Classification Search ..... 430/137.14, 430/137.15

See application file for complete search history.

(56) References Cited

U.S. PATENT DOCUMENTS 6,033,822 A 3/2000 Hasegawa et al.
6,258,911 B1 7/2001 Georges et al.
2002/0055050 A1* 5/2002 Serizawa et al. ..... 430/108.4
2004/0137348 A1* 7/2004 Sun et al. ..... 430/108.3
2004/0191665 A1* 9/2004 Watanabe et al. ..... 430/124
2004/0258434 A1* 12/2004 Yoshizaki et al. ..... 399/258
2004/0265718 A1* 12/2004 Nakamura et al. ..... 430/108.4

* cited by examiner

*Primary Examiner*—Mark F Huff
*Assistant Examiner*—Peter L Vajda
(74) *Attorney, Agent, or Firm*—Roylance, Abrams, Berdo & Goodman, L.L.P.

(57) ABSTRACT

A method of preparing a toner includes: preparing high molecular weight latex particles by polymerizing a toner composition including a macromonomer having a hydrophilic group, a hydrophobic group and at least one reactive functional group, at least one polymerizable monomer, a colorant and wax; aggregating the high molecular latex particles in the absence of an emulsifier, a colorant, and wax; and separating and drying the aggregated high molecular weight latex particles. A toner is prepared using the method described above. An image forming method using the toner and an image forming apparatus employing the toner are also provided. Using the method described above, polymerizable toner particles can be prepared using a simplified process and the colorant and was inside the toner can be easily dispersed.

13 Claims, 1 Drawing Sheet

METHOD OF PREPARING TONER AND TONER PREPARED USING THE METHOD

CROSS-REFERENCE TO RELATED PATENT APPLICATION

This application claims the benefit under 35 U.S.C. §119 (a) of Korean Patent Application No. 10-2006-0001312, filed on Jan. 05, 2006, in the Korean Intellectual Property Office, the disclosure of which is hereby incorporated by reference in its entirety.

BACKGROUND OF THE INVENTION

1. Field of the Invention

The present invention relates to a method of preparing a toner and a toner prepared by the method. More particularly, the invention is directed to a method of preparing a toner using latex particles, and the resulting a toner. The invention is further directed to an image forming method using the toner and an image forming apparatus employing the toner.

2. Description of the Related Art

In an electrophotographic process or an electrostatic recording process, a developer is used to form an electrostatic image or an electrostatic latent image. The developer can be a two-component developer formed of a toner and carrier particles or a one-component developer formed of a toner only, without carrier particles. The one-component developer may be a magnetic one-component developer or a nonmagnetic one-component developer. Plasticizers such as colloidal silica are often added independently into the nonmagnetic one-component developer to increase the flowability of the toner. Generally, coloring particles obtained by dispersing a colorant, such as carbon black, or other additives in a binding resin are used in the toner.

Methods of preparing toners include pulverization or polymerization. In the pulverization method, the toner is obtained by melt mixing synthetic resins with colorants and, if needed, other additives, pulverizing the mixture and classifying the particles until a desired size of particles is obtained. In the polymerization method, a polymerizable monomer composition is manufactured by uniformly dissolving or dispersing a polymerizable monomer, a colorant, a polymerization initiator and, if needed, various additives such as a cross-linking agent and an antistatic agent. Next, the polymerizable monomer composition is dispersed in an aqueous dispersive medium which includes a dispersion stabilizer using an agitator to form minute liquid drop particles. Subsequently, the temperature is increased and suspension polymerization is performed to obtain a polymerized toner having coloring polymer particles of a desired size.

In an image forming apparatus such as an electrophotographic apparatus or an electrostatic recording apparatus, an electrostatic latent image is formed through light exposure on the surface of a uniformly charged photoconductor. A toner is attached to the electrostatic latent image, and a resulting toner image is transferred to a transfer medium such as a paper through several processes such as heating, pressing, solvent steaming, etc. In most fixing processes, the transfer medium with the toner image passes through fixing rollers and pressing rollers, and by heating and pressing, the toner image is fused to the transfer medium.

Improvements in preciseness and minuteness are required for images formed by an image forming apparatus such as an electrophotocopier. Conventionally, a toner used in an image forming apparatus is usually obtained using pulverization of the toner material. When using pulverization, coloring particles with a wide range of particle sizes may be formed.

Hence, to obtain satisfactory developer properties, there is a need to classify the coloring particles obtained through pulverization according to size to narrow the particle size distribution. However, it is difficult to precisely control the particle size distribution using a conventional mixing/pulverizing process in the manufacture of toner particles suitable for an electrophotographic process or electrostatic recording process. Also when preparing a minute particle toner, the toner preparation yield is low due to a classification process. In addition, there is a limit to the amount of change/adjustment of a toner design for obtaining desirable charging and fixing properties. Accordingly, polymerized toners, in which the size of particles is easy to control and which do not need to go through a complex manufacturing process such as classification, have come into the spotlight recently.

When a toner is prepared using polymerization, the desired size distribution of particles is obtained without performing pulverization or classification.

U.S. Pat. No. 6,033,822 in the name of Hasegawa et al. discloses a polymerized toner including a core formed of colored polymer particles and a shell covering the core in molecules, wherein the polymerized toner is prepared by suspension polymerization. However, it is still difficult to adjust the shape of the toner and the sizes of the particles using the process. Also, the particle size distribution is wide.

U.S. Pat. No. 6,258,911 in the name of Michael et al. discloses a bi-functional polymer having a narrow polydispersity and an emulsion-condensation polymerization process for manufacturing a polymer having covalently bonded free radicals on each of its ends. However, even when this method is used, a surfactant can cause an adverse effect, and it is difficult to control the size of latex.

SUMMARY OF THE INVENTION

The present invention provides a method of preparing a toner in which a preparation process is simple, toner latex particles can be manufactured using an aggregation process and a colorant and wax inside the toner can be easily dispersed.

The present invention also provides a toner having superior properties of particle size regulation, storability and durability.

The present invention also provides an image forming method in which a high quality image can be fused at a low temperature by using a toner having superior properties in particle size control, storage property, and durability.

The present invention also provides an image forming apparatus in which a high quality image can be fused at a low temperature by using a toner having superior properties in particle size control, storage property, and durability.

According to an aspect of the present invention, a method of preparing a toner is provided including: preparing high molecular weight latex particles by polymerizing a toner composition including a macromonomer having a hydrophilic group, a hydrophobic group and at least one reactive functional group, at least one polymerizable monomer, a colorant and wax; aggregating the high molecular weight latex particles in the absence of an emulsifier, a colorant, and wax; and separating and drying the aggregated high molecular weight latex particles.

According to another aspect of the present invention, a toner including high molecular weight latex particles is obtained by polymerizing a toner composition including a macromonomer having a hydrophilic group, a hydrophobic group and at least one reactive functional group, at least one polymerizable monomer, a colorant, and wax, wherein the high molecular weight latex particles are aggregated in the absence of an emulsifier, a colorant, and wax, and the aggregated high molecular weight latex particles are separated and dried.

According to another aspect of the present invention, an image forming method is provided including: forming a visible image by disposing a toner on a photoconductor surface where an electrostatic latent image is formed; and transferring the visible image to a transfer medium, wherein the toner includes high molecular weight latex particles obtained by polymerizing a toner composition including a macromonomer having a hydrophilic group, a hydrophobic group and at least one reactive functional group, at least one polymerizable monomer, a colorant, and wax, wherein the high molecular weight latex particles are aggregated in the absence of an emulsifier, a colorant, and wax, and the aggregated high molecular latex particles are separated and dried.

According to another aspect of the present invention, an image forming apparatus is provided including: an organic photoconductor; an image forming unit to form an electrostatic latent image on a surface of the organic photoconductor; a toner cartridge to contain a toner including high molecular weight latex particles obtained by polymerizing a toner composition including a macromonomer having a hydrophilic group, a hydrophobic group and at least one reactive functional group, at least one polymerizable monomer, a colorant, and wax, wherein the high molecular weight latex particles are aggregated in the absence of an emulsifier, a colorant, and wax, and the aggregated high molecular latex particles are separated and dried; a toner supplying unit to transfer the toner to the surface of the organic photoconductor to develop an electrostatic latent image on the surface of the organic photoconductor into a toner image; and a unit transferring the toner image on the surface of the organic photoreceptor to a transfer medium.

According to the present invention, production processes are simplified and production costs are low by preparing a polymerized toner without using an emulsifier, wax, a colorant, etc. in the aggregation process.

These and other aspects of the invention will become apparent from the following detailed description of the invention, which taken in conjunction with the annexed drawing, disclose various embodiments of the invention.

BRIEF DESCRIPTION OF THE DRAWING

The above and other features and advantages of the present invention will become more apparent by describing in detail exemplary embodiments thereof with reference to the attached drawing in which.

DETAILED DESCRIPTION OF THE INVENTION

Figure 1:
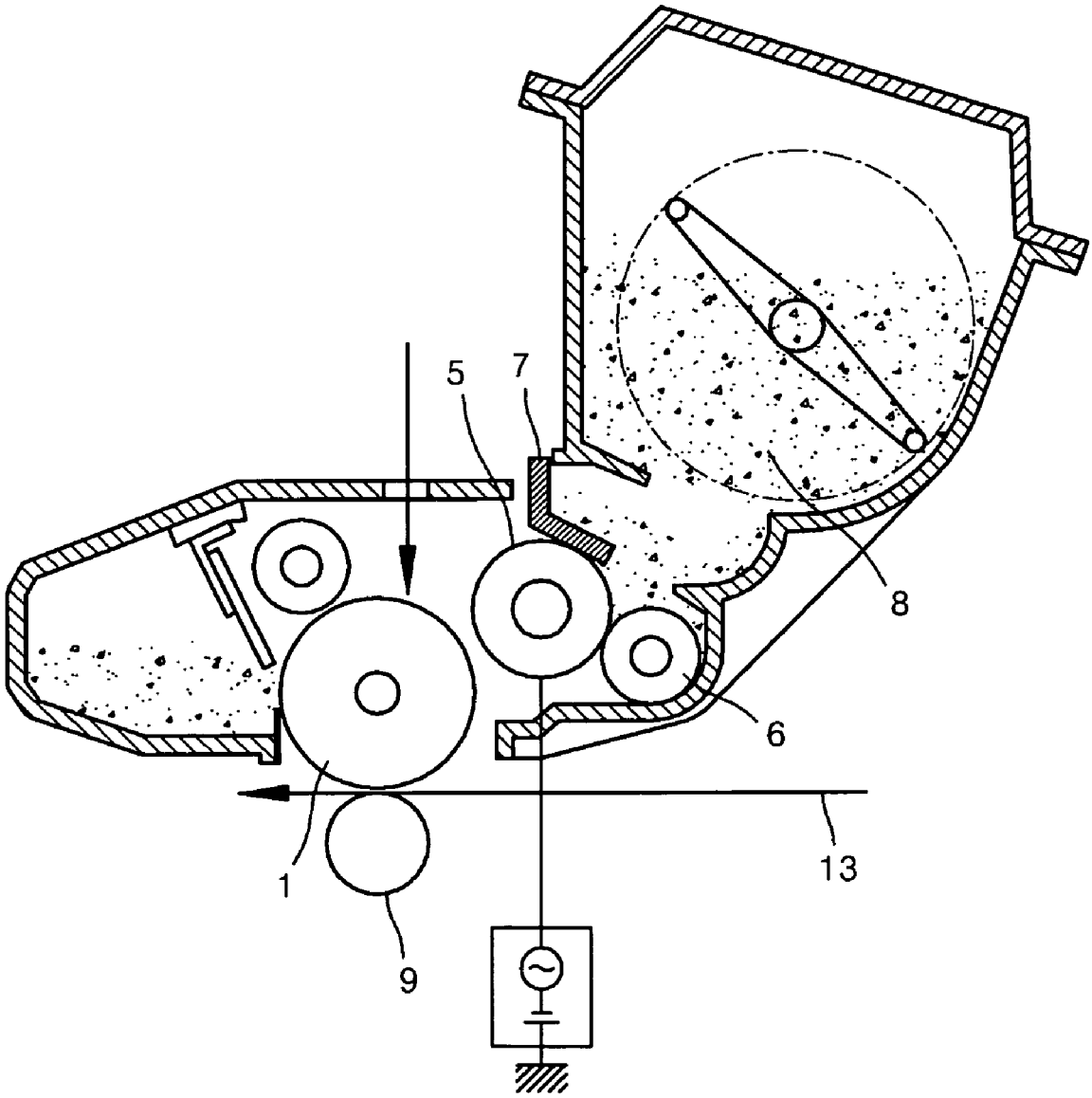
FIG. 1 is a schematic diagram of an image forming apparatus employing a toner prepared using a method according to an embodiment of the present invention.

An embodiment of the present invention provides a method of preparing a toner including: preparing high molecular weight latex particles by polymerizing a toner composition having a macromonomer having a hydrophilic group, a hydrophobic group and at least one reactive functional group, at least one polymerizable monomer, a colorant and wax; aggregating the high molecular weight latex particles in the absence of an emulsifier, a colorant, and wax; and separating and drying the aggregated high molecular weight latex particles.

According to one embodiment of the present invention, latex particles having a colorant and wax can be prepared using only one polymerization process step. The high molecular weight latex particles are aggregated in the absence of an emulsifier, a colorant, and wax to prepare a polymerized toner.

The current embodiment of the present invention is directed to a method of preparing a polymerized toner by aggregating high molecular weight latex particles having wax and a colorant without using an emulsifier during the aggregation process step. The speed of aggregation can be controlled by regulating the pH and ionic strength of the reaction product. Also, the size and shape of the toner particles can be controlled by regulating reaction conditions such as temperature, time of heating and revolutions per minute (RPM) of the reaction mixture.

According to one embodiment of the present invention, the emulsifier, the wax and the colorant are not used during the aggregation process. That is, the high molecular weight latex particles are aggregated without using the emulsifier, the colorant and the wax. This preparation process prevents problems such as environmental conditions, especially humidity and temperature, from sensitively causing a decrease of tribocharge and adhesive strength (or fixability) of the toner at high humidity in an emulsion aggregation toner. That is, the problems of the prior processes are solved by not using the emulsifiers during the aggregation process to prepare the polymerized toner because such problems are caused by the remaining emulsifier used to prepare emulsion aggregation toner. The remaining emulsifier may be removed during a cleaning process. However, the removal of the emulsifier is an equilibrium process, so to remove the emulsifier completely, much waste and polluted water are generated and production costs are increased.

According to one embodiment of the present invention, the macromonomer, used as a comonomer during the polymerization of the latex particles, maintains the stability of the latex particles in an aqueous solution. Hence, the emulsifier is not required and preferably is not used during the aggregation process.

In a conventional process of preparing a polymerized toner using an emulsifier, a wax dispersion and a colorant dispersion are separately prepared using an ionic emulsifier (for example, an anionic emulsifier.) High molecular weight latex particles are prepared using the emulsifier. Then the high molecular weight latex particles in a conventional process are dispersed together with the wax dispersion and the colorant dispersion, and then the toner particles are prepared using an aggregation process.

However, according to one embodiment of the present invention, latex particles already containing a colorant and wax are used. Accordingly, a polymerized toner is prepared by performing aggregation and coalescence processes at least at the glass transition temperature by regulating the pH, an electrolyte or a density of an inorganic salt in the absence of an emulsifier, a colorant, and wax. The shape and the size of the toner particles are regulated by controlling temperature, time of heating and revolutions per minute of the reaction mixture.

During the initial aggregation process, the latex particles having the colorant and the wax incorporated therein can be aggregated by regulating the pH of the dispersion or by adding the inorganic salt such as NaCl or $MgCl_2$. When the pH increases by adding alkali, the surfaces of the particles become negatively charged or relatively less positively charged. Such surfaces are mainly due to the macromonomer chain chemically connected to the surfaces, a sulfate group of an initiator such as potassium persulfate (KPS) and an acid group on the comonomer.

When a latex particle has a high negative value, that is, a high pH or a high value of zeta potential, the strength of particles repelling each other is too strong, so aggregation does not occur well. On the contrary, when a latex particle has a low pH or a low value of zeta potential, the dispersion stability of the particles decreases, so aggregation occurs. Also when the concentration or density of the electrolyte or the inorganic salt is higher than the density of a critical coagulation concentration, an electrostatic repulsion of the electrolyte counterbalances the attraction forces. Thus, aggregation occurs rapidly due to Brownian motion of the latex particles. When the density of the electrolyte or the inorganic salt is lower than the density of the critical coagulation concentration, aggregation occurs slowly.

Aggregating the high molecular weight latex particles may further include regulating ionic strength by adding an electrolyte or an inorganic salt. In the aggregation process, the size of the particles increases due to a collision between the latex particles.

According to the current embodiment of the present invention, the high molecular weight latex particles can be aggregated by heating the particles at least to the glass transition temperature. At the glass transition temperature and above, Gibbs free energy of latex high molecular chain increases, so the latex particles move freely. Hence, toner particles having smooth surfaces are prepared. The shapes of the toner particles can be regulated depending on the temperature.

A morphological difference of the toner particles relates to an interfacial force and a rheology of the toner particles. When the desired size and shape of the toner particles are obtained, they are cooled below the glass transition temperature, go through a filtration process and are then separated and dried. An additive such as silica, etc. may be further added while regulating the electric charge, etc. to the dried toner for use in a laser printer.

The macromonomer according to the current embodiment of the present invention is an amphipathic material having both a hydrophilic group and a hydrophobic group, and a polymer or an oligomer having at least one reactive functional group on each of its ends.

The hydrophilic group of the macromonomer chemically combined on the surface of the particle increases the long term stability of the toner particle by providing steric stability, and can control the particle size according to the amount or molecular weight of the macromonomer in the polymerization step. The hydrophobic group of the macromonomer promotes the emulsion polymerization by existing on the surface of toner particles. The macromonomer can form a copolymer by reacting with a polymerizable monomer in the toner composition in various ways, such as grafting, branching or cross-linking.

The weight average molecular weight of the macromonomer is in the range of about 100 to 100,000, and preferably in the range of about 1,000 to 10,000. When the weight average molecular weight of the macromonomer is less than 100, the properties of the toner may not be improved or the toner may not operate properly as a stabilizer. Also, when the weight average molecular weight of the macromonomer is greater than 100,000, a reaction conversion rate may be low.

The macromonomer according to the current embodiment of the present invention may be, for example selected from the group consisting of polyethylene glycol methacrylate, polyethylene glycol ethyl ether methacrylate, polyethylene glycol dimethacrylate, polyethylene glycol reforming urethane, polyethylene glycol reforming or modified polyester, polyacrylamide, polyethylene glycol hydroxyethyl methacrylate, hexafunctional polyester acrylate, dendritic polyester acrylate, carboxy polyester acrylate, fatty acid reforming or modified epoxy acrylate and polyester methacrylate, but is not limited thereto.

The amount of the macromonomer used in the current embodiment of the present invention may be in the range of about 1 to 50 parts by weight based on 100 parts by weight of the toner composition. When the amount of the macromonomer is less than 1 part by weight based on 100 parts by weight of the toner composition, the stability of the particle distribution is low, and when the amount of the macromonomer exceeds 50 parts by weight based on 100 parts by weight of the toner composition, the properties of the toner deteriorate.

The amphipathic macromonomer can act not only as a comonomer but also as a stabilizer. The reaction between initial radicals and monomers forms oligomer radicals, and provides an in situ stabilizing effect. The initiator decomposed by heat forms a radical, reacts with a monomer unit in an aqueous solution to form an oligomer radical, and increases hydrophobicity. The hydrophobicity of the oligomer radical accelerates the diffusion inside the micelle, accelerates the reaction with polymerizable monomers and facilitates a copolymerization reaction with a macromonomer.

The hydrophilicity of an amphipathic macromonomer enables the copolymerization reaction to occur more easily in the vicinity of the surface of toner particles. The hydrophilic portion of the macromonomer located on the surface of the particle increases the stability of the toner particle by providing steric stability, and can control the particle size according to the amount or molecular weight of the macromonomer introduced into the reaction mixture. Also, the functional group which reacts on the surface of the particle can improve the frictional electricity properties of the toner.

The polymerizable monomer used in the current embodiment of the present invention may include a monomer selected from the group consisting of a vinyl monomer, a polar monomer having a carboxyl group, a monomer having an unsaturated polyester group and a monomer having a fatty acid group.

The polymerizable monomer may be formed of at least one material selected from the group consisting of styrene-based monomer such as styrene, vinyltoluene, and α-methylstyrene; acrylic acid and methacrylic acid; (meth)acrylic acid derivative such as methylacrylate, ethylacrylate, propylacrylate, butylacrylate, 2-ethylhexylacrylate, dimethylaminoethylacrylate, methylmethacrylate, ethylmethacrylate, propylmethacrylate, butylmethacrylate, 2-ethylhexylmethacrylate, dimethylaminoethylmethacrylate, acrylonitrile, methacrylonitrile, acrylamide and methacrylamide; ethylenically unsaturated monoolefin such as ethylene, propylene and butylene; halogenated vinyl such as vinyl chloride, vinylidene chloride and vinyl fluoride; vinyl ester such as vinyl acetate and vinyl propionate; vinyl ether such as vinyl methyl ether and vinyl ethyl ether; vinyl ketone such as vinyl methyl ketone and methyl isopropenyl ketone; vinyl compound having nitrogen such as 2-vinyl pyridine, 4-vinyl pyridine and N-vinyl pyrrolidone, but is not limited thereto.

The amount of the polymerizable monomer used in the current embodiment of the present invention may be in the range of about 3 to 50 parts by weight based on 100 parts by weight of the toner composition. When the amount of the polymerizable monomer is less than 3 based on 100 parts by weight of the toner composition, the yield is low, and when the amount of the polymerizable monomer exceeds 50 based on 100 parts by weight of the toner composition, the stability of the toner composition is low.

The medium used in one embodiment of the present invention during the aggregation process may be selected from the group consisting of an aqueous solution, an organic solvent and a mixture of an aqueous solution and an organic solvent.

The detailed process of preparing a polymerized toner according to the current embodiment of the present invention will now be explained as follows.

First, high molecular weight latex particles are manufactured by polymerizing a toner composition having a macromonomer, a polymerizable monomer, a colorant and wax. While purging a reactor with nitrogen gas, a mixture of a medium such as distilled deionized water (or a mixture of water and an organic compound) and the macromonomer is injected into the reactor. The mixture is heated while stirring. During this time, an electrolyte such as NaCl or other inorganic salt may be added to control the ionic strength of the reactive medium. When the temperature inside the reactor reaches an appropriate value, an initiator, such as a water soluble free radical initiator is introduced. Subsequently, at least one polymerizable monomer is injected to the reactor semicontinuously. The polymerizable monomer can be introduced to the reactor with a chain transfer agent. To control the reaction rate and the degree of dispersion, the supply of the polymerizable monomer is performed sufficiently slowly using a starved condition process.

The colorant is dispersed in the mixture of the medium, the macromonomer and distilled deionized water, using a disperser to form a colorant dispersion. The colorant dispersion is injected to the reactor during a polymerization reaction and the polymerization reaction is allowed to continue. If the injection of the colorant dispersion is too early, the conversion rate of the reaction may be affected, and if the injection is too late, the content or dispersibility of the colorant may be adversely affected. After the polymerization reaction, the injection time of the wax is determined according to the speed of the reaction and the conversion rate. When the reaction is performed to some extent, a dispersion of wax dispersed in mixed monomers is injected to the reactor, and the initiator is further injected to continue the reaction. The time of the polymerization reaction is determined in a range of 6 hours to 12 hours based on the temperature and the experimental conditions, by measuring the speed of the reaction and the conversion rate. After the reaction, high molecular weight latex particles are prepared by further injecting the monomer to regulate the durability and other properties of the toner particles.

Accordingly, after the reaction is completed, the high molecular weight latex particles can go through an aggregation process to regulate the size and shape of the toner particles in the absence of an emulsifier, a colorant and wax in the dispersion. According to the current embodiment of the present invention, the emulsifier is not used when performing the aggregation process which aggregates the latex particles that already have the colorant and the wax contained therein at a temperature at least at the glass transition temperature. The speed of aggregation can be controlled by regulating the pH and the density of the electrolyte (or the inorganic salt) in the reactive medium.

According to the current embodiment of the present invention, the aggregation process of the high molecular latex particles does not involve the use of the emulsifier, the colorant and the wax, which minimizes a cleaning process during separation and filtration processes of the prepared toner particles. By minimizing the cleaning process, the preparation process is simplified, which reduces production costs. Also, generation of waste and polluted water is reduced, which is environmentally friendly. In addition, by not using the emulsifier, sensitivity, low tribo-charge, decrease of electricity, low toner flowability, etc. at high humidity can be prevented and storage stability of the toner can improve remarkably.

Accordingly, the aggregated latex particles are separated and dried, and an additive such as silica, etc. may be further added while regulating electric charge, etc. to the dried toner for use in a laser printer.

The toner according to the current embodiment of the present invention includes a colorant and wax. The colorant may be carbon black or aniline black in the case of a black toner. Also, it is easy to produce a color toner with a nonmagnetic toner according to an embodiment of the present invention. In the case of a color toner, carbon black is used as a colorant for black, and a yellow colorant, a magenta colorant and a cyan colorant are further included as colorants for the colors.

The yellow colorant may be a condensed nitrogen compound, an isoindolinone compound, an anthraquinone compound, an azo metal complex, or an aryl imide compound. For example, C.I. pigment yellow 12, 13, 14, 17, 62, 74, 83, 93, 94, 95, 109, 110, 111, 128, 129, 147, 168, 180, and the like may be used.

The magenta colorant may be a condensed nitrogen compound, anthraquinone, a quinacridone compound, a lake compound of basic dyestuff, a naphthol compound, a benzoimidazole compound, a thioindigo compound, or a perylene compound. For example, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, and the like may be used.

The cyan colorant may be a copper phthalocyanine compound or a derivative thereof, an anthraquinone compound, or a lake compound of basic dyestuff. For example, C.I. pigment blue 1, 7, 15, 15:1, 15:2, 15:3, 15:4, 60, 62, 66, and the like may be used.

These colorants may be used alone or in combinations of two or more types. A desired colorant is selected considering color, saturation, brightness, weatherability, and dispersability in a toner.

The amount of the colorant may be in the range of about 0.1 to 20 parts by weight based on the 100 parts by weight of a polymerizable monomer. The amount of the colorant is not particularly limited as long as it is sufficient to color the toner. When the amount of the colorant is less than 0.1 parts by weight, the coloring is insufficient. When the amount of the colorant exceeds 20 parts by weight, the production costs of the toner increases and the toner is unable to obtain enough friction charge.

A suitable wax which provides a desired characteristic of the final toner compound may be used. The wax may be polyethylene wax, polypropylene wax, silicone wax, paraffin wax, ester wax, carnauba wax or metallocene wax, but is not limited thereto. The melting point of the wax may be in the range of about 50 to about 150° C. Wax elements physically adhere to the toner particles, but do not covalently bond with the toner particles. The toner fixes to a final image receptor at a low fixation temperature and has superior final image durability and antiabrasion properties.

The toner composition according to the current embodiment of the present invention may further include at least one material selected from the group consisting of an initiator, a chain transfer agent, a release agent and a charge control agent.

Radicals in the toner composition are formed by the initiator, and the radical may react with the polymerizable monomer. The radical reacts with the polymerizable monomer and the reactive functional group of the macromonomer to form a copolymer.

Examples of the radical polymerized initiator include persulfates, such as potassium persulfate, ammonium persulfate, etc.; azo compounds, such as 4,4-azobis (4-cyanovaleric acid), dimethyl-2,2'-azobis(2-methylpropionate), 2,2-azobis (2-amidinopropane)dihydrochloride, 2,2-azobis-2-methyl-N-1,1-bis(hydroxymethyl)-2-hydroxyethylpropionamide, 2,2'-azobis(2,4-dimethylvaleronitrile), 2,2'-azobisisobutyronitrile, 1,1'-azobis(1-cyclohexanecarbonitrile), etc.; peroxides, such as methylethylperoxide, butylperoxide, acetylperoxide, dicumylperoxide, lauroylperoxide, benzoylperoxide, t-butylperoxide-2-ethylhexanoate, di-isopropylperoxydicarbonate, di-t-butylperoxyisophthalate, and the like. Also, an oxidation-reduction initiator, which is a combination of a polymerized initiator and a reducing agent, may be used.

The chain transfer agent is a material which converts a type of a chain carrier during a chain reaction. The conversion of the new chain carrier involves considerably reduced activity compared to the previous chain carrier. Using the chain transfer agent, the degree of polymerization of the monomer may be reduced, or the new chain reaction may be initiated. Also, the range of the molecular weight may be regulated using the chain transfer agent.

The chain transfer agent may include a compound having sulfur, such as dodecanethiol, thioglycolic acid, thioacetic acid or mercaptoethanol; a compound of phosphorous acid, such as phosphorous acid or sodium phosphorous acid; a compound of hypophosphorous acid, such as hypophosphorous acid or sodium hypophosphorous acid; and alcohol, such as methylalcohol, ethylalcohol, isopropylalcohol or n-butyl alcohol, but is not limited thereto.

The release agent protects a photoreceptor and prevents deterioration of developing properties, and thus may be used for the purpose of obtaining a high quality image. A release agent according to an embodiment of the present invention may use a solid fatty acid ester material with high purity. For example, a low molecular weight polyolefin, such as low molecular weight polyethylene, low molecular weight polypropylene, low molecular weight polybutylene, and the like; paraffin wax; or a multifunctional ester compound, and the like may be used. The release agent used in an embodiment of the present invention may be a multifunctional ester compound formed of an alcohol having at least three functional groups and carboxylic acid.

The polyhydric alcohol with at least three functional groups may be an aliphatic alcohol, such as glycerin, pentaerythritol, pentaglycerol, and the like; an alicyclic alcohol, such as chloroglycitol, quersitol, inositol, and the like; an aromatic alcohol, such as tris (hydroxymethyl) benzene, etc.; a sugar, such as D-erythrose, L-arabinose, D-mannose, D-galactose, D-fructose, sucrose, maltose, lactose, and the like; or a sugar-alcohol, such as erythrite, and the like.

The carboxylic acid may be an aliphatic carboxylic acid, such as acetic acid, butyric acid, caproic acid, enantate, caprylic acid, pelargonic acid, capric acid, undecanoic acid, lauric acid, myristic acid, stearic acid, magaric acid, arachidic acid, cerotic acid, sorbic acid, linoleic acid, linolenic acid, behenic acid, tetrolic acid, and the like; an alicyclic carboxylic acid, such as cyclohexanecarboxylic acid, hexahydroisophthalic acid, hexahydroterephthalic acid, 3,4,5,6-tetrahydrophthalic acid, etc.; or an aromatic carboxylic acid, such as benzoic acid, cumic acid, phthalic acid, isophthalic acid, terephthalic acid, trimeth acid, trimellitic acid, hemimellitic acid, and the like.

The charge control agent may be formed of a material selected from the group consisting of a salicylic acid compound containing a metal, such as zinc or aluminum, a boron complex of bisdiphenylglycolic acid, and silicate. More particularly, dialkyl salicylic acid zinc or borobis (1,1-diphenyl-1-oxo-acetyl potassium salt) may be used.

According to another embodiment of the present invention, a toner includes high molecular weight latex particles obtained by polymerizing a toner composition including a macromonomer having a hydrophilic group, a hydrophobic group and at least one reactive functional group, at least one polymerizable monomer, a colorant, and wax is provided, wherein the high molecular weight latex particles are aggregated in the condition of an emulsifier, a colorant, and wax, and the aggregated high molecular weight latex particles are separated and dried.

A radical formed by an initiator reacts with the polymerizable monomer, and the reactive functional group of the macromonomer, and may form a copolymer. The copolymer may be formed by copolymerizing at least one monomer selected from the group consisting of a vinyl monomer, a polar monomer having a carboxyl group, a monomer having an unsaturated polyester group and a monomer having a fatty acid group. The weight average molecular weight of the copolymer may be in the range of 2,000 to 200,000.

The weight average molecular weight of the macromonomer may be in the range of 100 to 100,000, and is preferably in the range of 1,000 to 10,000. The macromonomer may be formed of a material selected from the group consisting of polyethylene glycol (PEG)-methacrylate, PEG-ethyl ether methacrylate, PEG-dimethacrylate, PEG-modified urethane, PEG-modified polyester, polyacrylamide (PAM), PEG-hydroxyethyl methacrylate, hexafunctional polyester acrylate, dendritic polyester acrylate, carboxy polyester acrylate, fatty acid modified epoxy acrylate and polyester methacrylate, but is not limited thereto.

According to one embodiment of the present invention, the toner can control the speed of aggregation by regulating the pH during the aggregation process of the high molecular latex particles. Also, the electrolyte or the inorganic salt may be added during the aggregation process of the high molecular latex particles to control ionic strength of the high molecular latex particles.

An image forming method according to another embodiment of the present invention includes: forming a visible image by disposing a toner on a photoconductor surface where an electrostatic latent image is formed; and transferring the visible image to a transfer medium, wherein the toner includes high molecular latex particles obtained by polymerizing a toner composition including a macromonomer having a hydrophilic group, a hydrophobic group and at least one reactive functional group, at least one polymerizable monomer, a colorant, and wax, wherein the high molecular latex particles are aggregated in a medium that is free of an emulsifier, a colorant, and wax. In this manner, the latex particles are aggregated in the medium in the absence of an emulsifier, colorant and wax. The aggregated high molecular weight latex particles are then separated and dried.

An electrophotographic image forming process includes a charging process, a light-exposing process, a developing process, a transferring process, a fusing process, a cleaning process and an antistatic process, which are series of processes used to form an image on an image receptor.

In the charging process, the photoconductor is covered with electric charges of desired polarity, either negative or positive, by a corona or a charging roller. In the light-exposing process, an optical system, generally a laser scanner or an array of diodes, forms a latent image corresponding to a final visual image to be formed on an image receptor by selectively discharging the charging surface of the photoconductor in an imagewise manner. Electromagnetic radiation (hereinafter, "light") may include infrared radiation, visible rays and ultraviolet radiation.

In the developing process, in general, the toner particles with suitable polarity contact the latent image on the photoreceptor, and typically, an electrically biased developer which has a potential with the same polarity as the toner is used. The toner particles move to the photoreceptor, selectively adhere to the latent image through static electricity and form a toner image on the photoreceptor.

In the transferring process, the toner image is transferred from the photoreceptor to a desired final image receptor. Sometimes an intermediate transferring element is used to effect the transfer of the tone image from the photoreceptor to the final image receptor.

In the fusing process, the toner image is fused to the final image receptor by melting or softening the toner particles by heating the toner image on the final image receptor. Alternatively, the toner can be fused to the final image receptor under high pressure while being heated or without heating. In the cleaning process, the toner particles remaining on the photoreceptor are removed. In the antistatic process, an electric charge on the photoreceptor is exposed to light of a certain wavelength, and the electric charge is substantially decreased to a uniform low value. Consequentially, a residue of the latent image is removed and the photoreceptor is prepared for the image forming cycle.

An image forming apparatus according to another embodiment of the present invention includes: an organic photoconductor; a unit for electrifying a surface of the organic photoconductor; a unit for containing a toner including high molecular weight latex particles obtained by polymerizing a toner composition including a macromonomer having a hydrophilic group, a hydrophobic group and at least one reactive functional group, at least one polymerizable monomer, a colorant, and wax, wherein the high molecular weight latex particles are aggregated in the absence of an emulsifier, a colorant, and wax, and the aggregated high molecular latex particles are separated and dried; a unit for supplying the toner to the surface of the organic photoconductor to develop an electrostatic latent image on the surface of the organic photoconductor into a toner image; and a unit for transferring the toner image on the surface of the organic photoreceptor to a transfer medium.

FIG. 1 is a schematic diagram of a non-contact developing type image forming apparatus using a toner prepared using the method according to an embodiment of the present invention. The operating principles of the image forming apparatus are explained below.

A developer 8, which is a nonmagnetic one-component developer, is supplied to a developing roller 5 through a feeding roller 6 formed of an elastic material such as polyurethane form and sponge. The developer 8 supplied to the developing roller 5 reaches a contact point between the developing roller 5 and a developer regulation blade 7 as the developing roller 5 rotates. The developer regulation blade 7 is formed of an elastic material such as metal, rubber, and the like. When the developer 8 passes the contact point between the developing roller 5 and the developer regulation blade 7, the developer 8 is smoothed to form a thin layer and the developer 8 is sufficiently charged. The developing roller 5 transfers the thin layer of the developer 8 to a developing domain where the developer 8 is developed on the electrostatic latent image of a photoreceptor 1, which is a latent image carrier.

The developing roller 5 and the photoreceptor 1 face each other with a constant distance therebetween without contact. The developing roller 5 rotates counterclockwise and the photoreceptor 1 rotates clockwise. The developer 8 transferred to the developing domain forms an electrostatic latent image on the photoreceptor 1 according to the intensity of an electric charge generated due to a difference between a voltage applied to the developing roller 5 and a latent image potential of the photoreceptor 1.

The developer 8 developed on the photoreceptor 1 reaches a transferring device 9 as the photoreceptor 1 rotates. The developer 8 developed on the photoreceptor 1 is transferred through corona discharging or by a roller to a printing paper 13 as the printing paper 13 passes between the photoreceptor 1 and the transferring device 9 by the transferring device 9 to which a high voltage with an opposite polarity to the developer 8 is applied, and thus forms an image.

The image transferred to the printing paper 13 passes through a fusing device (not shown) that provides high temperature and high pressure, and the image is fused to the printing paper 13 as the developer 8 is fused to the printing paper 13. Meanwhile, remaining developer 8 on the developing roller 5 which is not developed is taken back by the feeding roller 6 contacting the developing roller 5. The above processes are repeated.

The present invention will now be described in greater detail with reference to the following examples. The following examples are for illustrative purposes only and are not intended to limit the scope of the invention.

EXAMPLES

Example 1

407 g of deionized water and 246 g of styrene-n-butyl acrylate-methacrylic acid-poly ethylene glycol-ethyl ether methacrylate copolymer latex having wax (ester wax, WE-5) and cyan pigment (15:3, Cu-Phthalocyanine, DIC) obtained by using a one-step polymerization process were injected to a 1-L reactor and the resultant was stirred at 300 RPM. The pH of the resultant was titrated to pH 2 and was heated slowly. When the average volumetric particle size of the toner particles became 7 μm, the pH of the resultant was then titrated to pH 11 and heated up to 95° C. After about one hour of heating to obtain desired shapes of toner particles, the product was allowed to cool and be filtered.

Example 2

1221 g of deionized water and 738 g of copolymer latex prepared in the same manner as in Example 1 having the wax and the cyan pigment obtained by using the one-step polymerization process were injected to a 3-L reactor, and the resultant was stirred at 350 RPM. The pH of the resultant was titrated to pH 2 and was heated slowly. When the average volumetric particle size of the toner particles became 7 μm, the pH of the resultant was then titrated to pH 11 and heated up to 95° C. After about two hours of heating to obtain desired shapes of toner particles, the product was allowed to cool and be filtered.

Example 3

1221 g of deionized water and 738 g of copolymer latex prepared in the same manner as in Example 1 having the cyan pigment and the wax were injected to a reactor, and the resultant was stirred at normal temperature. The pH of the resultant was titrated to pH 2. During the initial aggregation process, 30 g of NaCl, dissolved in 480 g of deionized water, was added to the reactor and the resultant mixture was stirred at 350 RPM. The temperature of the resultant mixture was increased to 80° C. slowly. When the average volumetric particle size of the toner particles became 7 μm, the temperature of the resultant mixture was then increased to 95° C. After a further 30 minutes of heating, the toner particles were obtained after cooling and filtering the product.

Example 4

1221 g of deionized water and 738 g of copolymer latex prepared in the same manner as in Example 1 having the cyan pigment and the wax were injected to a reactor, stirred at normal temperature and the pH of the resultant was titrated to pH 11. During the initial aggregation process, 30 g of NaCl, dissolved in 480 g of deionized water, was added to the reactor and the resultant mixture was stirred at 350 RPM. The temperature of the resultant mixture was increased to 95° C. slowly. When the average volumetric particle size of the toner particles became 7 μm, the resultant mixture was heated for a further 30 minutes, and the toner particles were obtained after cooling and filtering the product.

Example 5

407 g of deionized water and 246 g of copolymer latex prepared in the same manner as in Example 1 having the cyan pigment and the wax were injected in a reactor and the resultant was stirred at 300 RPM in normal temperature to titrate the pH of the resultant to pH 11. After at least one hour of stirring, 12.5 g of $MgCl_2$, dissolved in 20 g of deionized water during the initial aggregation process, was added, and the resultant mixture was stirred. The temperature of the resultant mixture was increased to 85° C. slowly. When the average volumetric particle size of the toner particles became 5 μm, the number of revolutions per minute was increased to 350 RPM and 40 g of NaCl, dissolved in 160 g of deionized water, was added to the resultant mixture. The temperature was then increased to 95□ and the result was heated for 2 more hours. When the average volumetric particle size and number average particle size of toner particles became 7 μm and 5 μm respectively, heating was stopped and the product was allowed to cool and be filtered to obtain toner particles.

Example 6

1221 g of deionized water and 738 g of copolymer latex prepared in the same manner as in Example 1 having the cyan pigment and the wax were injected to a reactor, and the resultant was stirred at 300 RPM at a normal temperature to titrate the pH to pH 11. After at least one hour of stirring, 37.5 g of $MgCl_2$, dissolved in 60 g of deionized water, was added to the resultant during the initial aggregation process and the resultant mixture was stirred. The temperature of the resultant mixture was increased to 85° C. slowly. When the average volumetric particle size of the toner particles became 5 μm, the number of revolutions per minute was increased to 350 RPM and 120 g of NaCl, dissolved in 480 g of deionized water, was added to the resultant mixture. The temperature of the result was increased to 95° C. and heated for 2 more hours. When the average volumetric particle size and number average particle size of toner particles became 7 μm and 5 μm respectively, heating was stopped, and the product was allowed to cool and be filtered to obtain toner particles.

Example 7

1221 g of deionized water and 738 g of copolymer latex prepared in the same manner as in Example 1 having the cyan pigment and the wax were injected in a reactor, and a resultant was stirred at 350 RPM at a normal temperature to titrate the pH to pH 11. 37.5 g of $MgCl_2$, dissolved in 60 g of deionized water, was added to the resultant during the initial aggregation process. The temperature of the resultant mixture was increased to 95° C. slowly. When the average volumetric particle size of the toner particles became 5 μm, 120 g of NaCl, dissolved in 480 g of deionized water, was added to the resultant mixture which was heated for two more hours. The temperature of the result was increased to 95° C. and heated for 2 more hours. When the average volumetric particle size and number average particle size of toner particles became 7 μm and 5 μm respectively, heating was stopped and the product was allowed to cool and be filtered to obtain toner particles.

Comparative Example 1

307 g of ultra-high pure water, wherein 2.0 g of SDS emulsifier was dissolved, was added to 346 g of styrene-n-butyl acrylate copolymer latex particles previously polymerized using an emulsifier, and the resultant was stirred. Also, 18.2 g of an aqueous solution of pigment particles (cyan 15:3, 40 solidity %), dispersed using an SDS emulsifier, and a wax dispersion, dispersed in SDS emulsifiers, were added to the resultant. While stirring the resultant mixture at 350 RPM, the pH of the latex pigment dispersion aqueous solution was titrated to pH 10 using a 10% NaOH buffer solution. 30 g of ultra-high pure water was dissolved in 10 g of an aggregating agent $MgCl_2$, and the mixture was dropwise added to the latex pigment dispersion aqueous solution. Then the temperature of the result was increased to 95° C. After about 7 hours of heating to obtain a desired size of toner particles, the reaction was stopped and the product was allowed to cool naturally. The obtained average volumetric size of toner particles was about 10.5 μm.

According to the present invention, a polymerized toner is prepared by aggregating high molecular latex particles without using an emulsifier, a colorant and wax. The size and shape of the toner particles are easily regulated, which is advantageous in preparing a toner having small size particles. Also, production costs are low, the cleaning process is simplified and generation of waste and polluted water is reduced which is environmentally friendly. Owing to the improved wax dispersibility, fixability of the toner is improved and the anti-offset properties, friction electric charge properties and storage stability of the toner are superior, allowing the realization of high quality images. Also, the polymerized toner has superior properties in high humidity conditions.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of preparing a toner comprising:

preparing high molecular weight latex particles by polymerizing a toner composition comprising a macromonomer having a hydrophilic group, a hydrophobic group and at least one reactive functional group, a colorant, a wax and at least one polymerizable monomer to form the high molecular weight latex particles;

aggregating the high molecular weight latex particles in the absence of an emulsifier, a colorant, and wax to form the toner particles; and separating and drying the toner particles obtained from the aggregated high molecular weight latex particles, wherein the step of aggregating the high molecular weight latex particles comprises regulating a pH to control the speed of aggregation, wherein the macromonomer is selected from the group consisting of polyethylene glycol methacrylate, polyethylene glycol ethyl ether methacrylate, polyethylene glycol dimethacrylate, polyethylene glycol reforming urethane, polyethylene glycol reforming polyester, polyacrylamide, polyethylene glycol hydroxyethyl methacrylate, hexafunctional polyester acrylate, dendritic polyester acrylate, carboxy polyester acrylate, fatty acid reforming epoxy acrylate and polyester methacrylate.

2. The method of claim 1, wherein the aggregating the high molecular weight latex particles further comprises adding an electrolyte or an inorganic salt to regulate ionic strength.

3. The method of claim 2, wherein the inorganic salt comprises NaCl or $MgCl_2$.

4. The method of claim 1, wherein the high molecular weight latex particles are aggregated by increasing the temperature to a temperature of at least the glass transition temperature (Tg) of the latex particles.

5. The method of claim 1, wherein the toner composition further comprises at least one material selected from the group consisting of an initiator, a chain transfer agent, a charge control agent and a release agent.

6. The method of claim 1, wherein the weight average molecular weight of the macromonomer is in the range of about 100 to 100,000.

7. The method of claim 1, wherein the amount of the macromonomer is in the range of about 1 to 50 parts by weight based on 100 parts by weight of the toner composition.

8. The method of claim 1, wherein the polymerizable monomer comprises at least one monomer selected from the group consisting of a vinyl monomer, a polar monomer having a carboxyl group, a monomer having an unsaturated polyester group and a monomer having a fatty acid group.

9. The method of claim 8, wherein the polymerizable monomer is at least one material selected from the group consisting of a styrene-based monomer selected from the group consisting of styrene, vinyltoluene, and a-methylstyrene; acrylic acid; methacrylic acid; a (meth)acrylic acid derivative selected from the group consisting of methylacrylate, ethylacrylate, propylacrylate, butylacrylate, 2-ethyihexylacrylate, dimethylaminoethylacrylate, methylmethacrylate, ethylmethacrylate, propylmethacrylate, butylmethacrylate, 2-ethylliexylmethacrylate, dimethylaminoethylmethacrylate, acrylonitrile, methacrylonitrile, acrylamide and methacrylamide; an ethylenically unsaturated monoolefin selected from the group consisting of ethylene, propylene and butylene; a halogenated vinyl selected from the group consisting of vinyl chloride, vinylidene chloride and vinyl fluoride; a vinyl ester selected from the group consisting of vinyl acetate and vinyl propionate; a vinyl ether selected from the group consisting of vinyl methyl ether and vinyl ethyl ether; a vinyl ketone selected from the group consisting of vinyl methyl ketone and methyl isopropenyl ketone; and a vinyl compound having nitrogen selected from the group consisting of 2-vinyl pyridine, 4-vinyl pyridine and N-vinyl pyrrolidone.

10. The method of claim 1, wherein the amount of the polymerizable monomer is in the range of about 3 to 50 parts by weight based on 100 parts by weight of the toner composition.

11. The method of claim 1, wherein the colorant comprises a material selected from the group consisting of yellow, magenta, cyan and black pigments.

12. A method of preparing toner particles comprising the steps of:

polymerizing a toner composition in a reaction medium to obtain a dispersion of latex polymer particles, the toner composition including a macromolecule, a colorant, a wax, and at least one polymerizable monomer, wherein said macromolecule has a hydrophilic group, a hydrophobic group and at least one reactive group to form the high molecular weight latex particles;

aggregating the resulting latex polymer particles in the reaction medium in the absence of an emulsifier, colorant and wax to form the toner particles; and separating and drying the toner particles produced from aggregated latex polymer particles, wherein the aggregating the latex polymer particles comprises regulating a pH to control the speed of aggregation, wherein the macromonomer is selected from the group consisting of polyethylene glycol methacrylate, polyethylene glycol ethyl ether methacrylate, polyethylene glycol dimethacrylate, polyethylene glycol reforming urethane, polyethylene glycol reforming polyester, polyacrylamide, polyethylene glycol hydroxyethyl methacrylate, hexafunctional polyester acrylate, dendritic polyester acrylate, carboxy polyester acrylate, fatty acid reforming epoxy acrylate and polyester methacrylate.

13. The method of claim 12, wherein said polymerization comprises polymerizing said macromolecule and at least one monomer in the presence of an initiator in the reaction medium to form a first reaction mixture;

producing a colorant dispersion of a colorant and the macromonomer, admixing the colorant dispersion with the first reaction mixture during said polymerizing step; and introducing a wax dispersion containing a monomer to said first reaction mixture and further polymerizing to produce said latex polymer particles.

* * * * *